US006588228B2

(12) United States Patent
Choi

(10) Patent No.: US 6,588,228 B2
(45) Date of Patent: Jul. 8, 2003

(54) INTEGRATED AIR CONDITIONER WITH A FAN CASING

(75) Inventor: Heung-Seob Choi, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/100,175

(22) Filed: Mar. 19, 2002

(65) Prior Publication Data

US 2003/0084682 A1 May 8, 2003

(30) Foreign Application Priority Data

Nov. 8, 2001 (KR) ..... 2001-69434

(51) Int. Cl.[7] ..... F25D 17/06

(52) U.S. Cl. ..... 62/426; 415/204; 415/206; 415/211.1; 415/211.2

(58) Field of Search ..... 62/426; 415/204, 415/206, 211.1, 211.2

(56) References Cited

U.S. PATENT DOCUMENTS 1,884,898 A * 10/1932 Smith, Jr.
2,710,510 A * 1/1955 Roseman ..... 62/426
3,394,755 A * 7/1968 Morrison ..... 165/103
3,524,328 A * 8/1970 Schuster ..... 62/426
5,065,597 A * 11/1991 Farfaglia et al. ..... 62/262
5,222,374 A * 6/1993 Thompson et al. ..... 62/426
RE35,118 E * 12/1995 Gerber ..... 241/86.1
5,839,879 A * 11/1998 Kameoka et al. ..... 415/206
6,182,460 B1 2/2001 Hernandez et al.
6,273,679 B1 * 8/2001 Na ..... 415/204

* cited by examiner

*Primary Examiner*—William E. Tapolcai
*Assistant Examiner*—Mohammad M. Ali
(74) *Attorney, Agent, or Firm*—Staas & Halsey LLP

(57) ABSTRACT

An integrated air conditioner with a fan casing is provided to reduce flowing resistance of air discharged therefrom, and to achieve increase of wind flow rate and reduction of noise owing to air discharged therefrom. The fan casing includes a fan-housing unit having a volute space in which a blower fan is rotatably mounted and an outlet space combined with the volute space. The volute space of the fan-housing unit is provided at an inner top surface of the volute space with a concave recess leading to an upper surface of the outlet space such that the overall inner surface of the volute space takes a shape of Archimedes' spiral. The fan casing also includes a front panel attached to a front face of the fan-housing unit, which is provided with an air intake opening and a turning plate bent forward. The turning plate defines an outlet duct by combination with the outlet space to direct room air in the volute space to a front air outlet through the outlet space.

13 Claims, 9 Drawing Sheets

INTEGRATED AIR CONDITIONER WITH A FAN CASING

CROSS-REFERENCE TO RELATED APPLICATIONS

This application claims the benefit of Korean Application No. 2001-69434, filed Nov. 8, 2001, in the Korean Industrial Property Office, the disclosure of which is incorporated herein by reference.

BACKGROUND OF THE INVENTION

1. Field of the Invention

The present invention relates to an integrated air conditioner, and more particularly, to an integrated air conditioner with a fan casing having a blower fan intended to suck room air from a room to thereby cause the room air to be subjected to heat exchange and discharge the heat-exchanged room air back to the room.

2. Description of the Related Art

In general, air conditioners are divided into two main kinds: integrated-type air conditioners in which evaporators and condensers constituting refrigerating cycles are housed in one cabinet, and split-type air conditioners in which evaporators and condensers are housed in separate cabinets. In the integrated-type air conditioner, the cabinet is projected from a window toward a room at an evaporator section of the cabinet, and projected to an outside at a remaining condenser section of the cabinet. Accordingly, the integrated-type of air conditioner is also referred to as a window-type air conditioner.

The conventional integrated air conditioner includes a cabinet in which a blower fan and a propeller fan are mounted to be rotated concurrently by one motor. The evaporator is disposed in front of the blower fan, and the condenser is disposed at the rear of the propeller fan. A front face of the cabinet is provided with a front grille having a room air inlet to suck room air, and a room air outlet to discharge heat-exchanged room air. At a rear section, the cabinet is provided with an external air inlet and an external air outlet. The blower fan, which is disposed in a fan casing positioned behind the evaporator, is adapted to suck room air heat exchanged at the evaporator and then discharge the room air back to a room.

FIGS. 1 to 3 show a fan casing of a conventional integrated air conditioner. As shown in FIG. 1, the conventional fan casing includes a fan-housing unit 2 and a front panel 3 attached to a front face of the fan-housing unit 2. The front panel 3 has an air intake opening 3*a*.

As shown in FIGS. 1 and 2, the front panel 3 is made of a metal plate and is provided with the air intake opening 3*a* having a circular shape. A side of the front panel 3 has a turning plate 3*b*, which defines an outlet duct 5 and serves to direct heat exchanged room air to a room air outlet of a front grille (not shown). The turning plate 3*b* is bent toward the room air outlet of the front grille at a right angle at the side of the front panel 3 of the fan casing 1.

As shown in FIGS. 1 and 3, the fan-housing unit 2 of the fan casing 1 is usually made of a heat insulating material (e.g., expanded polystyrene). A side of the fan-housing unit 2 has a volute space 2*a* in which a blower fan 4 is installed with a circumferential spacing therearound. An inner surface of the volute space 2*a* is configured to have an Archimedes' spiral curved surface, which is also called an involute curved surface. The fan-housing unit 2 also has a side with an outlet space 2*b* which is combined with an upper portion of the volute space 2*a*. The outlet space 2*b* and the turning plate 3*b* define the outlet duct 5. An uppermost portion (a portion directly above a rotating axis of the blower fan 4) of the volute space 2*a* combined with the outlet space 2*b* has a horizontally extended section 2*c*. The horizontal extended section is intended to prevent a vertical height "H" of the fan-housing unit 2 from being increased. Generally, where the Archimedes' spiral surface is extended to the uppermost point of the volute space 2*a*, the vertical height "H" of the fan-housing unit 2 must be increased to strengthen an upper portion of the fan-housing unit 2, thereby causing an overall size of the integrated-type air conditioner to be increased.

When the blower fan 4 is rotated, room air which has been heat exchanged at an evaporator (not shown), is sucked into the volute space 2*a* through the intake opening 3*a*, and then flows into the outlet duct 5 while being in contact with an inner surface of the volute space 2*a*. Subsequently, the heat exchanged room air is discharged into a room through a room air outlet of the front grille to condition air in the room.

However, since the turning plate 3*b* of the front panel 3 that partly defines the outlet duct 5 of a conventional integrated air conditioner is abruptly bent, room air discharged therethrough is subjected to considerable flow resistance. Furthermore, since the uppermost portion of the volute space 2*a* has the horizontally extended portion 2*c* to decrease the vertical height "H" of the fan-housing unit 2, airflow at the horizontal extended portion 2*c* is not to be smooth.

As a result, the conventional integrated air conditioner has disadvantages in that considerably high noise is generated due to airflow resistance at the uppermost portion of the fan-housing unit 2, thus resulting in a decrease in flow rate during an operation of the air conditioner.

SUMMARY OF THE INVENTION

Accordingly, it is an object of the present invention to provide an integrated air conditioner with a fan casing intended to reduce resistance to air flow and to increase flow rate by improving the fan casing. The fan casing is provided with a volute space to receive a blower fan, and includes an outlet duct.

Additional objects and advantages of the invention will be set forth in part in the description which follows and, in part, will be obvious from the description, or may be learned by practice of the invention.

The foregoing and other objects of the present invention are achieved by providing an integrated air conditioner with a fan casing. The fan casing has a fan-housing unit having a volute space in which a blower fan is rotatably mounted and an outlet space combined with the volute space. The volute space of the fan-housing unit is provided at an inner top surface of the volute space with a concave recess leading to an upper surface of the outlet space such that an entire inner surface of the volute space takes a shape of Archimedes' spiral. The fan casing also has a front panel attached to a front face of the fan-housing unit, which is provided with an air intake opening and a turning plate bent forward. The turning plate defines an outlet duct by combining with the outlet space to direct room air in the volute space to a front air outlet through the outlet space.

According to an aspect of the invention, the fan-housing unit is formed at a top wall of the fan-housing unit with an upper opening of a predetermined area, and is provided with a guide plate covering an upper surface of the fan-housing including the upper opening. The guide plate has a concave recess at a lower surface of the guide plate corresponding to the upper opening.

According to an aspect of the invention, the guide plate includes a first protrusion to be engaged with a side edge of the upper opening and a second protrusion to be engaged with the other side edge of the upper opening such that the concave recess is defined between the first and second protrusion.

According to another aspect of the invention, the fan-housing unit is provided at an upper surface of the fan-housing unit with a stepped portion so that the guide plate is stably seated on the fan-housing unit.

According to another aspect of the invention, the fan-housing unit is shaped by heat insulating material, and the guide plate is injection molded by plastic material.

According to yet another aspect of the invention, the turning plate of the front panel is formed at a bent portion of the turning plate with an inclined face such that room air in the volute space is smoothly directed forward.

BRIEF DESCRIPTION OF THE DRAWINGS

These and other objects and advantages of the invention will become apparent and more appreciated from the following description of the preferred embodiments, taken in conjunction with the accompanying drawings of which.

DETAILED DESCRIPTION OF THE PREFERRED EMBODIMENTS

Figure 1:
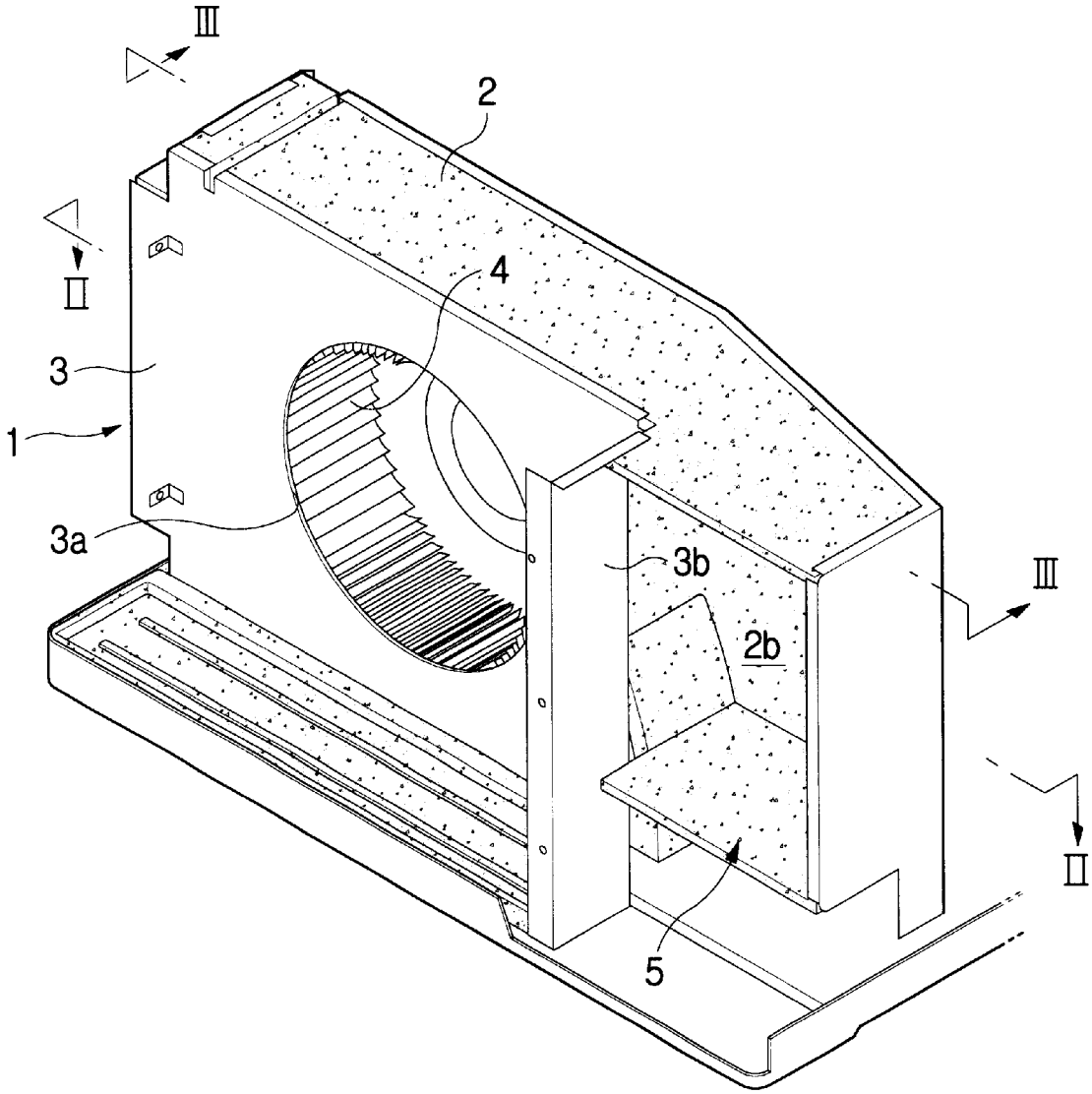
FIG. 1 (PRIOR ART)
FIG. 1 is a perspective view showing a fan casing of a conventional integrated air conditioner.
Figure 2:
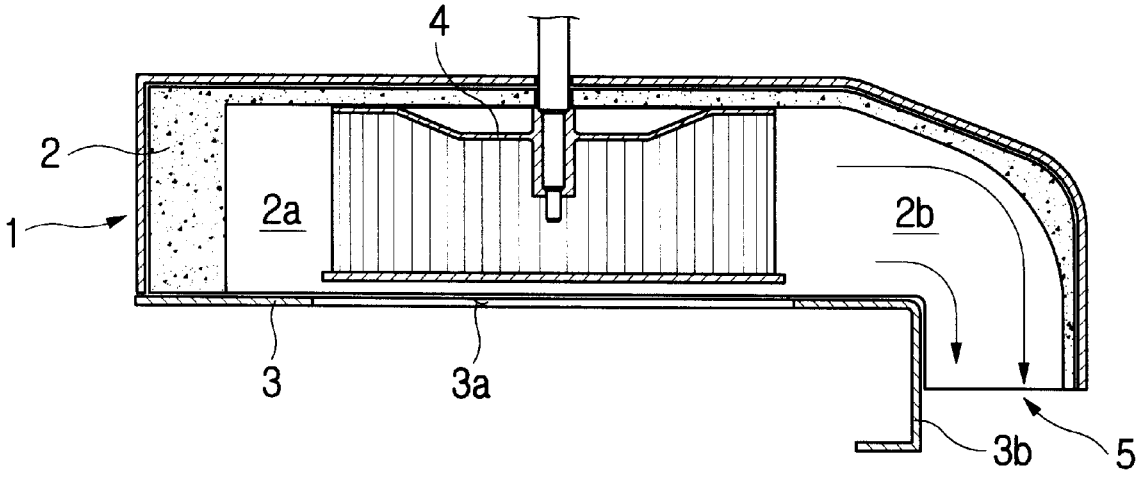
FIG. 2 (PRIOR ART)
FIG. 2 is a cross-sectional view taken along line II—II of FIG. 1.
Figure 3:
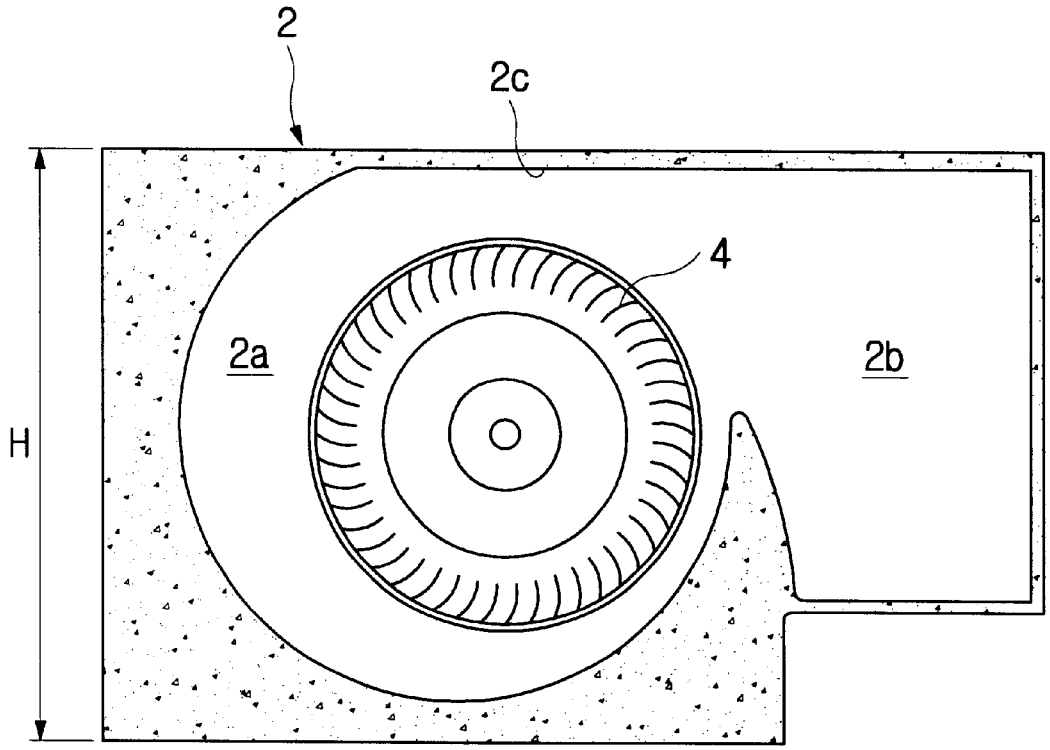
FIG. 3 (PRIOR ART)
FIG. 3 is a cross-sectional view taken along line III—III of FIG. 1.

Reference will now be made in detail to the present preferred embodiments of the present invention, examples of which are illustrated in the accompanying drawings, wherein like reference numerals to like elements throughout.

Figure 4:
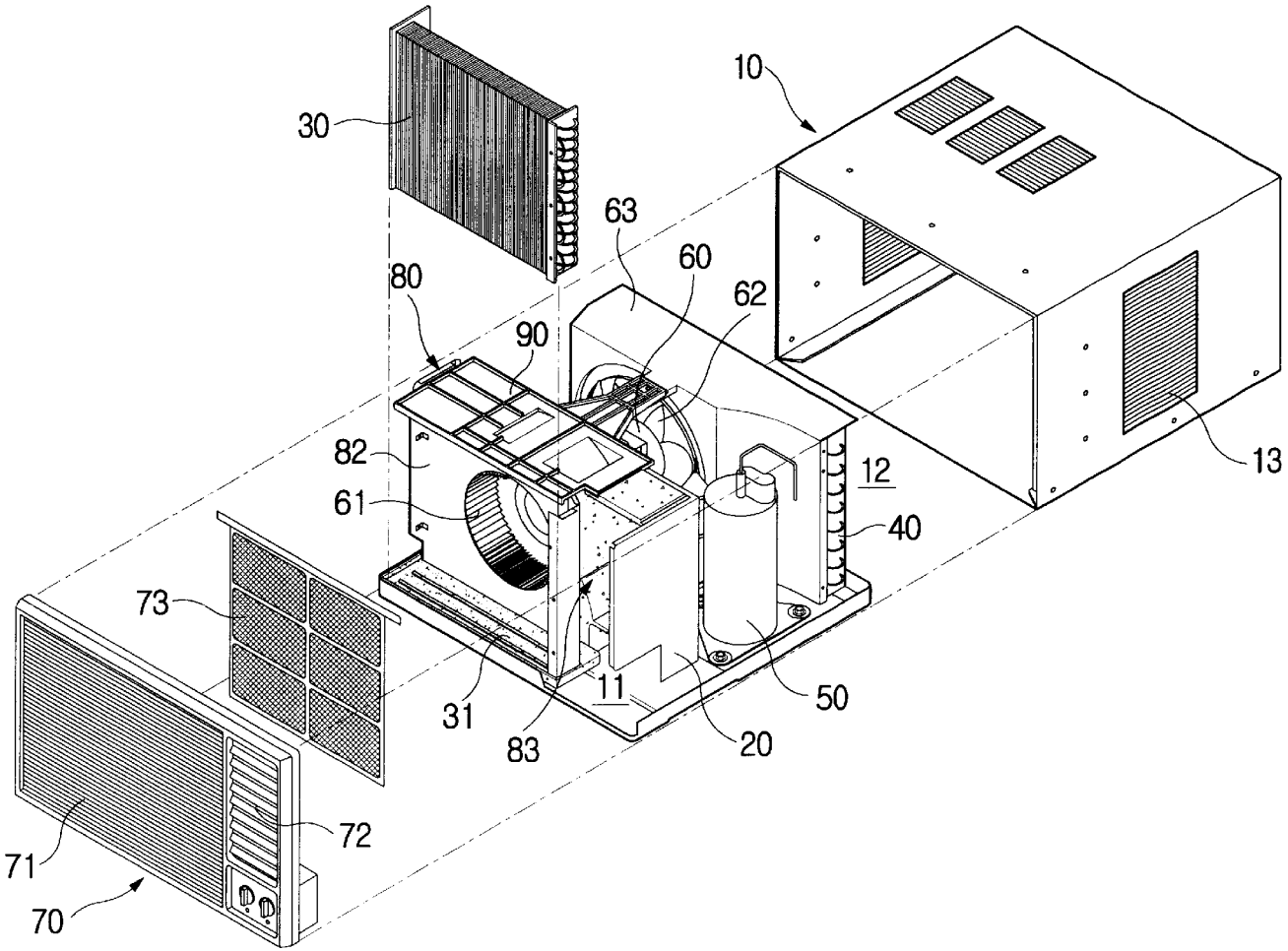
FIG. 4 is an exploded perspective view showing an integrated air conditioner, according to an embodiment of the present invention.

FIG. 4 is an exploded perspective view showing an integrated air conditioner, according to an embodiment of the present invention.

As shown in FIG. 4, the integrated air conditioner includes a cabinet 10 constituting an outer appearance of the air conditioner, an evaporator 30 and a condenser 40 disposed in a front and a rear of the cabinet 10, and a compressor 50. The compressor 50 compresses refrigerant having undergone evaporation at the evaporator 30, and then supplies the refrigerant to the condenser 40. The integrated air conditioner also has a blower fan 61 to suck room air, and thereby allow the room air to be heat exchanged at the evaporator 30 and then, send the room air back to a room. The integrated air conditioner also has a propeller fan 62 and a fan motor 60 to suck outdoor air, thereby causing the refrigerant in the condenser 40 to be condensed and then discharging the outdoor air outside the room. The integrated air conditioner has a front grille 70 that covers a front face of the cabinet 10. The front grille 70 includes a room air inlet 71 and a room air outlet 72.

The cabinet 10 has a box-shaped body and an interior space, which is divided by a partition frame 20 into an evaporating chamber 11 disposed in the evaporator 30 and a condensing chamber 12 disposed in the condenser 40.

The condensing chamber 12 is located in a rear half of the cabinet 10 to be exposed to outdoor air when the air conditioner is installed. The condensing chamber 12 houses the condenser 40 which constitutes a refrigerating cycle, the propeller fan 62, the fan motor 60 which drives the propeller fan 62 and the blower fan 61, and the compressor 50. The propeller fan 62 is surrounded by a hood 63.

The condenser 40 is located at a rearmost side of the cabinet 10. The cabinet 10 enclosing the condensing chamber 12, is formed with outdoor air inlets 13. A rear cover (not shown) disposed at a rear face of the cabinet 10 is formed with an outdoor outlet (not shown).

The evaporating chamber 11 is located in a front half space of the cabinet 10 to be exposed to an indoor side when the air conditioner is installed. The evaporating chamber 11 houses the evaporator 30 which constitutes a refrigerating cycle, a fan casing 80 in which the blower fan 61 is rotatably received, and a water tray 31 to collect condensed water generated from the evaporator 30.

The evaporator 30 is positioned near the room air inlet 71. The water tray 31 is disposed below the evaporator 30. Disposed between the evaporator 30 and the room air inlet 71 of the front grille 70, is an air filter 73 to filter sucked room air.

Figure 5:
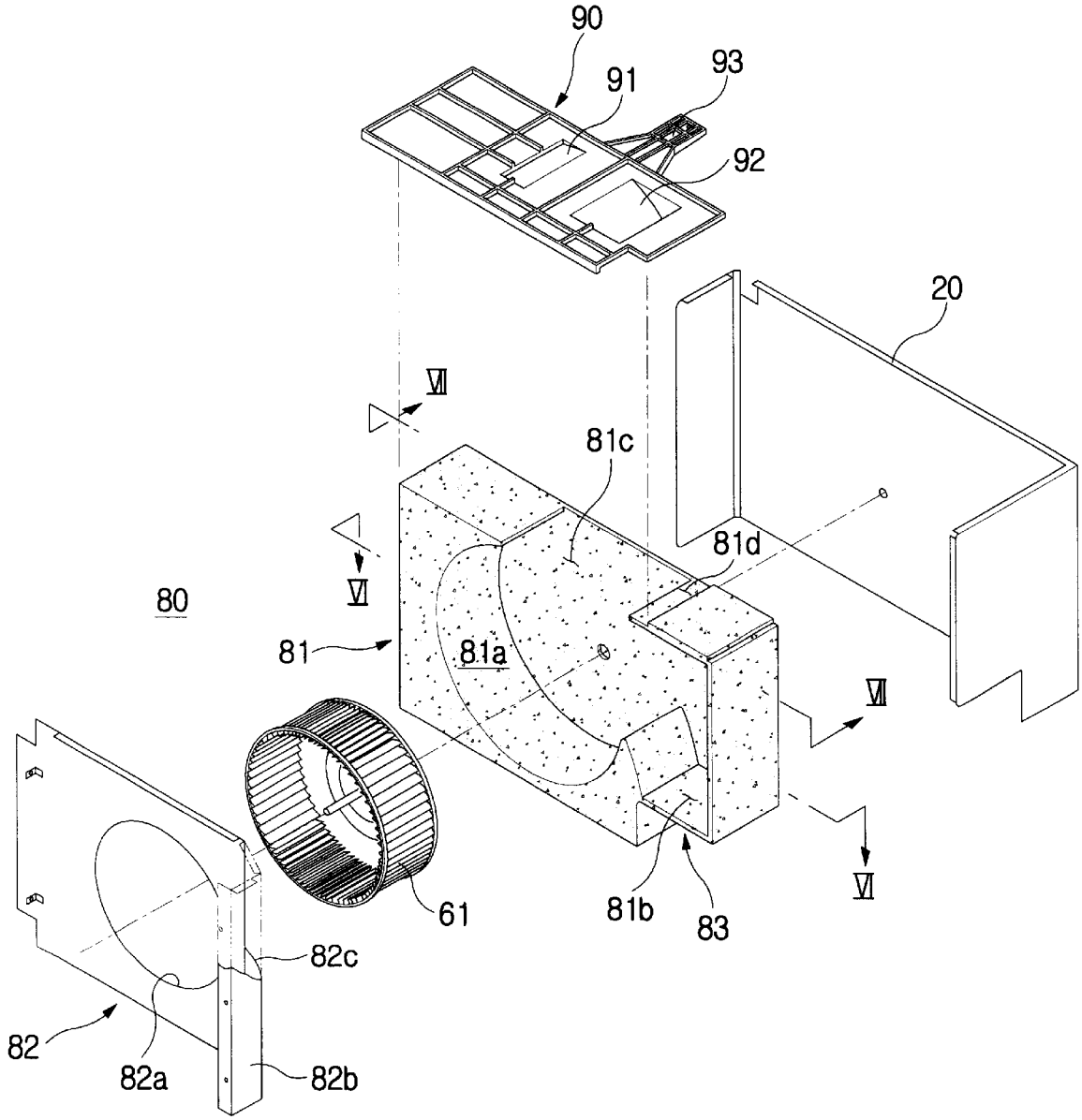
FIG. 5 is an exploded perspective view showing a fan casing, according to an embodiment of the present invention.

As shown in FIG. 5, the fan casing 80 includes a fan-housing unit 81 having a volute space 81*a* in which the blower fan 61 is rotatably disposed. The fan casing 80 also includes an outlet space 81*b* and a front panel 82 attached to a front face of the fan-housing unit 81 and having an air intake opening 82*a* to allow heat exchanged room air to be introduced therethrough.

Figure 6:
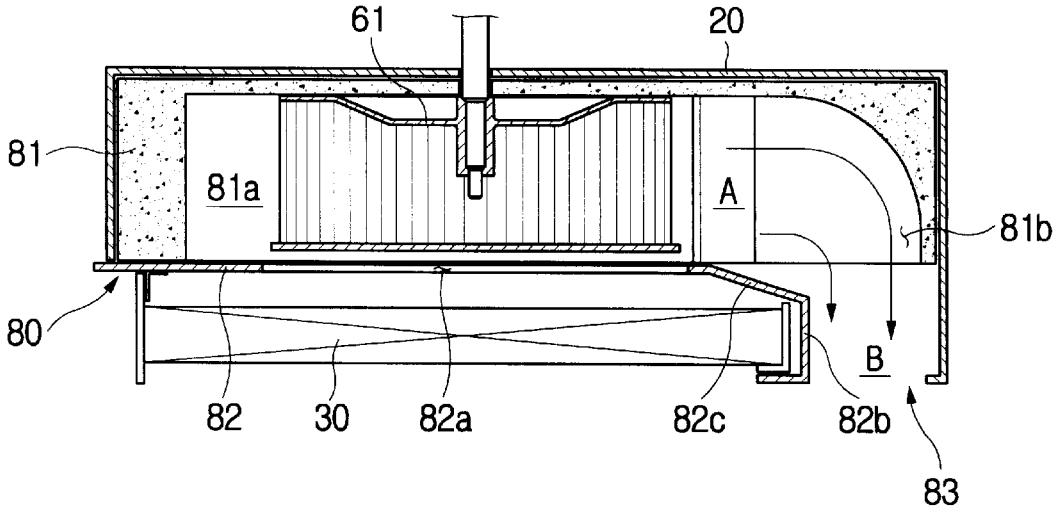
FIG. 6 is a cross-sectional view taken along line VI—VI of FIG. 5, which shows an interior of the fan casing, according to an embodiment of the present invention.

As shown in FIGS. 5 and 6, the front panel 82 of the fan casing 80 is made of a metal plate, and includes the air intake opening 82*a* to allow room air to be introduced into the volute space 81*a*. The front panel 82 also includes a turning plate 82*b* to direct the room air flow to the room air outlet 72 of the front grille 70. The turning plate 82*b* is prepared by bending a side portion of the front panel 82 toward the room air outlet 72 of the front grille 70. The turning plate 82*b* and a side-wall of the partition frame 20 defines an outlet duct 83. An intermediate portion 82*c* provided between the main front panel 82 and the turning plate 82*b*, is positioned to more smoothly direct flow of the room air flow to the room air outlet 72.

The intermediate portion 82*c* is obliquely shaped by bending the turning plate 82*b* at two vertical bending lines. Thus, change of flowing direction of air from an inlet "A"

to an outlet "B" of the outlet space 81*b* is easily achieved. That is, with the intermediate portion 82*c* bent toward the outlet duct 83, flow resistance of room air is remarkably reduced. Details of the above phenomenon will be described later.

Figure 7:
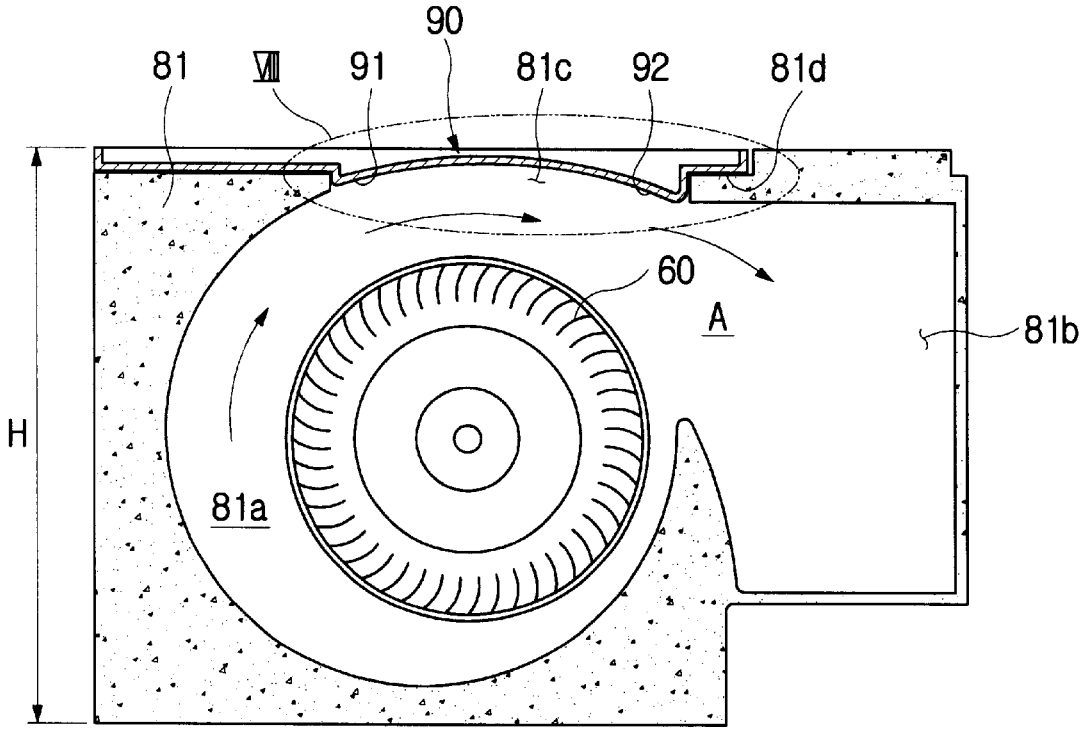
FIG. 7 is a cross-sectional view taken along line VII—VII of FIG. 5, which shows an interior of the fan casing, according to an embodiment of the present invention.
Figure 8:
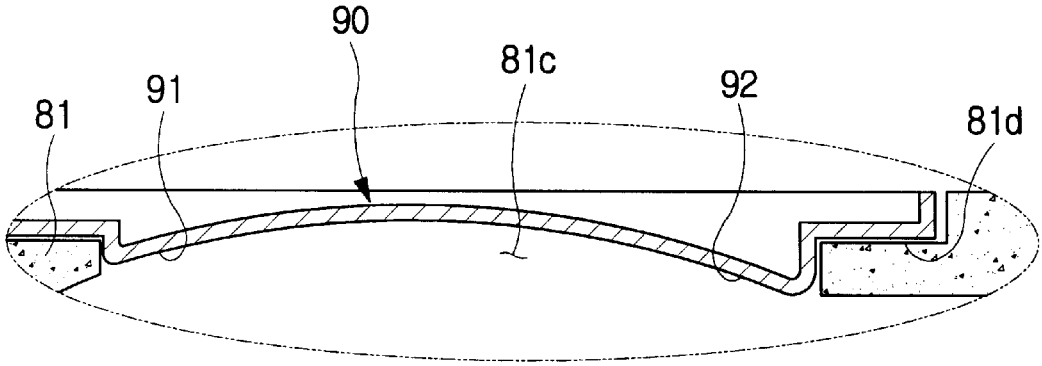
FIG. 8 is an enlarged cross-sectional view of a part designated by VIII of FIG. 7, according to an embodiment of the present invention.

As shown in FIGS. 5 and 7, the fan-housing unit 81 of the fan casing 80 is typically made of heat insulating foam material by an injection molding process to prevent heat of an outside of the fan-housing unit 81 from being transferred to an inside thereof. A rear face of the fan-housing unit 81 is surrounded with the partition frame 20. The fan-housing unit 80 is provided with the volute space 81*a* on one side and the outlet space 81*b* on the other side.

The outlet space 81*b* is combined with an upper portion of the volute space 81*a* such that an upper surface defining the outlet space 81*b* coincides with an upper surface defining the volute space 81*a*. The outlet space 81*b* is combined with the outlet duct 83 by the turning plate 82*b* of the front panel 82. Accordingly, an inner surface defining the outlet duct 83 is prepared by the turning plate 82*b* of the front panel 82. An outer surface defining the outlet duct 83 is properly curved by the fan-housing unit 81, which is molded by expanded polystyrene.

The blower fan 61 is rotatably received in the volute space 81*a*. An inner rounded surface defining the volute space 81*a* is configured to have a distance from the rotating axis of the blower fan 61 which is increased in the flowing direction of air (i.e., a curvature changing along the length of Archimedes' spiral line). This enables room air to be easily discharged to the inlet "A" of the outlet space 81*b* during rotation of the blower fan 61.

The uppermost portion of the volute space 81*a* is formed with an upper opening 81*c*. The upper opening 81*c* is covered with a guide plate 90.

The upper opening 81*c* is provided at an upper wall of the fan-housing unit 81 such that the upper opening 81*c* occupies a predetermined area with reference to a point directly over the rotating axis of the blower fan 61. The predetermined area extends to the inlet "A" of the outlet space 81*b*. The fan-housing unit 81 is formed at an upper surface of the fan-housing unit 81 with a stepped portion 81*d*.

The guide plate 90, made from plastic material, is disposed on both the stepped portion 81*d* and the upper surface of the fan-housing unit 81, opposite to the stepped portion 81*d*. The guide plate 90 is provided with a first protrusion 91 and a second protrusion 92 at a lower surface of the guide plate 90. The first and second protrusions 91 and 92 correspond to the upper opening 81*c* such that a lower surface of an area between the first and second protrusions 91 and 92 constitutes a part of the Archimedes' spiral line defining the inner surface of the volute space 81*a*. The first protrusion 91 is located at a side edge of the upper opening 81*c* and curved upwardly to have a bow shape. The second protrusion 92 is located at the other side edge of the upper opening 81*c* and leads to the inlet "A" of the outlet space 81*b*. Therefore, the inner surface of the volute space 81*a* takes an approximate shape of Archimedes' spiral by a shaping of the guide plate 90 having the first and second protrusions 91 and 92.

As shown in FIGS. 4 and 5, a fixing extension 93 is extended to the hood 63 and fastened thereto by screws so that the guide plate 90 is maintained in a stable fixed position on the fan-housing unit 81.

The guide plate 90 is shaped to have about 2 mm of thickness by a plastic injection molding process, which serves to protect an upper surface of the fan-housing unit 81 from damage. In addition, as mentioned above, the guide plate 90 functions to enable the overall inner surface of the volute space 81*a* to take the shape of a complete Archimedes' spiral (also called "volute curve") without increasing a vertical height "H" of the fan-housing unit 81.

Operations and functions of the integrated air conditioner according to an embodiment of the present invention is described below.

High temperature and high pressure refrigerant from the compressor 50 is supplied to the condenser 40 where the refrigerant is condensed. The condensed refrigerant is then directed to the evaporator 30. This circulation of the refrigerant is repeatedly performed. With activation of the fan motor 60, the blower fan 61 and the propeller fan 62 are rotated concurrently.

Outdoor air is sucked into the condensing chamber 12 through the outdoor air inlets by rotation of the propeller fan 62. The sucked outdoor air is discharged back to the outdoor atmosphere while cooling the condenser 40 to cause the refrigerant in the condenser 40 to be condensed.

Room air is sucked into the evaporating chamber 11 through the room air inlet 71 by rotation of the blower fan 61. Then, the room air arrives at the evaporator 30 where the room air is cooled. The cooled room air is discharged back to the room through the volute space 81*a*, the outlet duct 83, and the room air outlet 72.

Since the inner surface of the volute space 81*a* is configured to approximate the shape of Archimedes' spiral, there is little flow resistance in the volute space 81*a*. This allows room air sucked through the air intake opening 82*a* to be more easily and smoothly directed to the outlet duct 83 along the inner surface of the volute space 81*a*.

Furthermore, since the turning plate 82*b* defining the outlet duct 83 is provided with the intermediate portion 82*c* inclined toward the outlet "B" of the outlet space 81*b*, a redirecting of flowing air from the inlet "A" to the outlet "B" of the outlet space 81*b* is more smoothly achieved.

Functions of the present invention are described below with reference to FIG. 9 and Table 1.

TABLE 1

Indoor air flow rate according to RPM of blower fans of integrated air conditioner.

| RPM | Indoor air flow rate of a conventional air conditioner | Indoor air flow rate of the air conditioner of the present invention |
|---|---|---|
| 1038 | 6.54 CMM | 6.96 CMM |
| 1018 | 6.41 CMM | 6.83 CMM |
| 980 | 6.18 CMM | 6.57 CMM |
| 965 | 6.09 CMM | 6.47 CMM |
| 955 | 6.02 CMM | 6.41 CMM |
| 940 | 5.93 CMM | 6.31 CMM |
| 895 | 5.63 CMM | 6.00 CMM |
| 865 | 5.45 CMM | 5.80 CMM |

Figure 9:
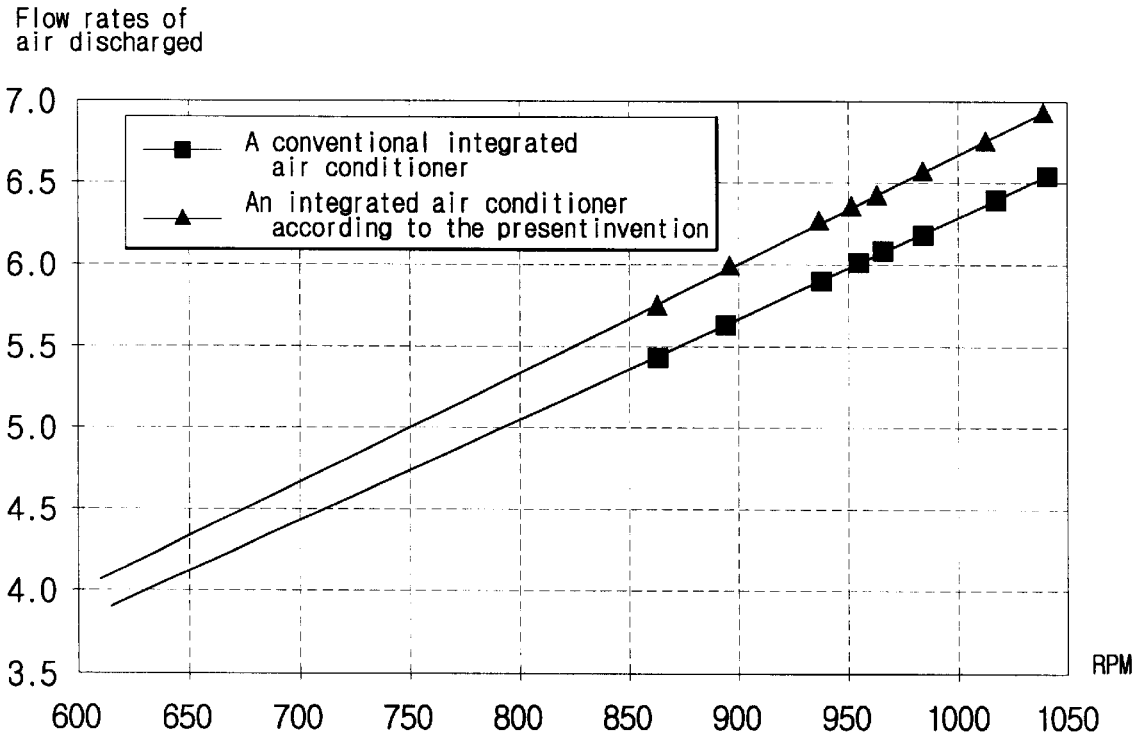
FIG. 9 is a graph showing increases in flow rates of air discharged into a room according to RPM changes of a blower fan of a conventional integrated air conditioner and an integrated air conditioner according to the present invention.

FIG. 9 is a graph shoving increase in air flow rate according to change of RPM of a blower fan on the basis of Table 1.

As shown in Table 1 and FIG. 9, it will be appreciated that indoor air flow rates by the integrated air conditioner according to the present invention are increased by about 6.5% (0.3–0.4 CMM), as compared with a conventional integrated air conditioner.

Since the turning plate 82*b* is gradually changed in a turning angle by means of the inclined intermediate portion 82*c*, and an overall inner surface of the volute space 81*a* and the guide plate 90 having the first and second protrusions 91 and 92 takes the shape of an approximate Archimedes' spiral, room air sucked into the volute space 81*a* is directed to the room air outlet 72 with little flow resistance.

In the above embodiment, although the guide plate 90 is separately provided to the fan-housing unit 81 to prevent damage of the fan-housing unit 81, a concave recess may be formed at a height of the volute space 81*a* without necessitating increase of the height of fan-housing unit 81 when the fan-housing unit 81 is manufactured by material having sufficient rigidity to support the fan-housing unit 81 (for example, a plastic injection molded fan-housing unit). In this case, a separated guide plate is not required.

As described above, the present invention provides an integrated air conditioner with a fan casing which is provided at a turning plate of the fan casing with an inclined mediate portion. A top of the fan casing is formed with an upper opening on which a guide plate having a concave recess is formed such that a volute space of the fan casing has a shape of an approximate Archimedes' spiral without increasing a height of the fan casing. Therefore, the fan casing of the present invention enables resistance of room air flowing in an inner volute space of the fan casing to be remarkably reduced. Accordingly the room air is easily and smoothly discharged to a room, thereby enhancing air flow rate of room air and reducing noise caused by discharged room air.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An integrated air conditioner with a fan casing, the fan casing comprising:

a fan-housing unit having a volute space in which a blower fan is rotatably mounted and an outlet space combined with the volute space, wherein an inner top surface of the volute space has a concave recess leading to an upper surface of the outlet space such that an entire inner surface of the volute space takes a shape of Archimedes' spiral; and a front panel attached to a front face of the fan-housing unit, has an air intake opening and a turning plate having a bent portion which is bent forward, wherein the turning plate defines an outlet duct by combining with the outlet space to direct room air in the volute space to a front air outlet through the outlet space, wherein a top wall of the fan-housing unit is formed with an upper opening of a predetermined area and includes a guide plate covering an upper surface of the fan-housing unit including the upper opening, and a lower surface of the guide plate has a concave recess corresponding to the upper opening.

2. The integrated air conditioner with a fan casing as set forth in claim 1, wherein the bent portion of the turning plate of the front panel has an inclined face such that room air in the volute space is smoothly directed forward.

3. The integrated air conditioner with a fan casing as set forth in claim 1, wherein the outlet space is combined with an upper portion of the volute space such that the upper surface defining the outlet space coincides with an upper surface defining the volute space.

4. The integrated air conditioner with a fan casing as set forth in claim 1, wherein the guide plate includes a first protrusion to be engaged with a side edge of the upper opening, and a second protrusion to be engaged with the other side edge of the upper opening such that the concave recess is defined between the first and second protrusion.

5. The integrated air conditioner with a fan casing as set forth in claim 1, wherein the upper surface of the fan-housing unit includes a stepped portion so that the guide plate is stably seated on the fan-housing unit.

6. The integrated air conditioner with a fan casing as set forth in claim 1, wherein the fan-housing unit is shaped by a heat insulating material, and the guide plate is injection molded by a plastic material.

7. The integrated air conditioner with a fan casing as set forth in claim 1, wherein the guide plate includes a fixing extension to maintain the guide plate in a fixed position to the fan-housing unit.

8. The integrated air conditioner with a fan casing as set forth in claim 4, wherein the lower surface of an area between the first and second protrusions include a part of the Archimedes' spiral which defines the inner surface of the volute space.

9. An apparatus comprising:

a fan casing including:

a turning plate with an intermediate portion; and an upper opening on which a guide plate having a concave recess is positioned so that a volute space of the fan casing has a shape of Archimedes' spiral.

10. The apparatus as set forth in claim 9, wherein the volute space of the fan casing has the shape of Archimedes' spiral without increasing a height of the fan casing.

11. The apparatus as set forth in claim 9, wherein a highest portion of the guide plate is no higher than a top surface of the fan casing.

12. An apparatus comprising:

a fan casing including:

a fan-housing unit having a volute space, wherein an inner top surface of the volute space has a concave recess to allow an entire inner surface of the volute space to have a shape of Archimedes' spiral, wherein a top wall of the fan-housing unit is formed with an upper opening of a predetermined area and includes a guide plate covering an upper surface of the fan-housing unit including the upper opening, and a lower surface of the guide plate has a concave recess corresponding to the upper opening.

13. An apparatus comprising:

a fan casing including:

a fan-housing unit having a volute space combined with an outlet space, wherein an inner top surface of the volute space has a concave recess so that the volute space has a shape of Archimedes' spiral; and a turning plate having a bent portion, wherein the turning plate defines an outlet duct by combining with the outlet space to direct room air in the volute space to a front air outlet through the outlet space, wherein a top wall of the fan-housing unit is formed with an upper opening of a predetermined area and includes a guide plate covering an upper surface of the fan-housing unit including the upper opening, and a lower surface of the guide plate has a concave recess corresponding to the upper opening.

* * * * *